US010950212B1

(12) United States Patent
Mathur

(10) Patent No.: US 10,950,212 B1
(45) Date of Patent: Mar. 16, 2021

(54) ACOUSTIC META MATERIAL PASSIVE SPIRAL AUDIO AMPLIFIER AND A METHOD TO MAKE THE SAME

(71) Applicant: Acoustic Metamaterials LLC, Scarsdale, NY (US)

(72) Inventor: Gopal P. Mathur, Trabuco Canyon, CA (US)

(73) Assignee: ACOUSTIC METAMATERIALS LLC, Scarsdale, NY (US)

( * ) Notice: Subject to any disclaimer, the term of this patent is extended or adjusted under 35 U.S.C. 154(b) by 0 days.

(21) Appl. No.: 16/799,938

(22) Filed: Feb. 25, 2020

(51) Int. Cl.
*G10K 11/08* (2006.01)
*H04R 1/02* (2006.01)
*H04R 1/34* (2006.01)

(52) U.S. Cl.
CPC ..... *G10K 11/08* (2013.01); *H04R 1/028* (2013.01); *H04R 1/345* (2013.01); *H04R 2499/11* (2013.01); *H04R 2499/15* (2013.01)

(58) Field of Classification Search
CPC ..... H04R 1/2857; H04R 1/30; H04R 1/2826; H04R 1/2853; H04R 1/021; H04R 2205/021; H04R 2499/11; H04R 1/02; H04R 1/2888; H04R 1/025; H04R 1/2819; H04R 1/345; H04R 2201/029; H04R 5/02
See application file for complete search history.

(56) References Cited

U.S. PATENT DOCUMENTS

| | | | | |
|---|---|---|---|---|
| 8,320,597 | B2 * | 11/2012 | Griffin, Jr. | H04R 1/30 381/339 |
| 8,430,201 | B1 * | 4/2013 | Weidner | H04R 1/2888 181/199 |
| 9,161,119 | B2 | 10/2015 | Powell | |
| 2003/0150668 | A1 * | 8/2003 | Nichols | H04R 1/2857 181/193 |
| 2010/0219012 | A1 * | 9/2010 | Baumbach | G10K 11/025 181/177 |
| 2014/0161294 | A1 * | 6/2014 | Haymond | H04R 1/30 381/341 |
| 2018/0206027 | A1 * | 7/2018 | Dekel | H04R 1/2857 |

* cited by examiner

*Primary Examiner* — Fan S Tsang
*Assistant Examiner* — Julie X Dang
(74) *Attorney, Agent, or Firm* — Michael J. Feigin, Esq.; Feigin and Fridman LLC

(57) ABSTRACT

An acoustic meta material (AMM) spiral device for passive amplification of sound is described. The AMM amplifier device employs at least one deep sub-wavelength spiral design with high refraction index, based on an exponential spiral shape. The AMM spiral amplifier is used to focus on low frequency sound amplification and to cover broadband frequency range. Sound emanating from a speaker travels into a spiral channel until reaching the apex of the spiral. When twin spirals are used, the sound then enters a second spiral for radiating into open air.

12 Claims, 9 Drawing Sheets

ACOUSTIC META MATERIAL PASSIVE SPIRAL AUDIO AMPLIFIER AND A METHOD TO MAKE THE SAME

FIELD OF THE DISCLOSED TECHNOLOGY

The present disclosure relates generally to passive amplification of acoustic sound and more specifically to amplification of sound of loudspeakers and other devices in the broad band frequency region using passive acoustic meta material (AMM) spiral amplifier devices.

BACKGROUND OF THE DISCLOSED TECHNOLOGY

Loudspeakers are integral/critical parts of all audio systems. Loudspeakers convert electrical energy into mechanical energy, which in turn is converted into acoustic energy. Ideally, a loudspeaker should create a sound field proportional to the electric signal of the amplifier. Due to the physics of sound radiation, this paradigm has not been achieved, particularly in the low frequency region (<300 Hz). Thus, loudspeakers are known as the weakest link in any sound reproduction scheme. A well-designed speaker may only be around 5% efficient. The low efficiency of the loudspeaker generates more heat than sound power output while adding undesired distortion to the output signal. The frequency response of a conventional loudspeaker usually rolls off faster at low frequencies (<300 Hz). Consequently, most loudspeaker systems employ more than one driver; such as subwoofers (very low frequencies); woofers (low frequencies); mid-range speakers; tweeters; and sometimes super-tweeters, to adequately reproduce a wide range of frequencies with even coverage. Also, the production of a good high-fidelity loudspeaker has required that the speakers be enclosed in a ported box, which acts like a Helmholtz resonator.

Miniaturization and integration of acoustic devices have been an important consideration in recent times. Consumer electronic devices, such as cell phones, laptops, tablets, and the like, with more features and capabilities, are ubiquitous and are positioning to become audio entertainment centers. However, they also exhibit severe audio deficiencies and pose many additional challenges to maintain the acoustic performance as enclosed acoustic volume size, power and membrane size are reduced significantly. Due to the smaller size of the speaker used in such devices, the low frequency response is severely affected. For example, as the size of the cell (or mobile) phone decreases, the volume of air behind the diaphragm is reduced. This small amount of volume behind the diaphragm is reduced, thus limiting the range of motion of the diaphragm. The speaker does not produce enough force to compress the air beyond a certain point, hence causing the air to push back. This reduces the displacement of the speaker diaphragm, which in turn lowers the output. Thus, low frequencies are affected the most by this phenomenon as the diaphragm moves with the largest amount of displacement at these frequencies. Consequently, the frequency response usually rolls off faster at low frequencies, herein referred to as "bass frequencies" which are those which are audible or able to be sensed by a human and are below 300 Hertz.

While the video screens of smartphones, tablets and notebooks have seen stunning improvements, audio performance has lagged far behind. Smartphone speakers still sound quiet and metallic, and are limited by their tiny size. Because micro speakers must be small, it is easy to move the diaphragm further than the maximum allowable excursion (typically around 0.4 mm). As speakers get thinner, the excursion becomes smaller, which is a major restriction on output sound level. A speaker's biggest excursion problem comes at and near its resonant frequency. The resonant frequency of micro-speakers is typically around 1000 Hz. At the resonant frequency the membrane moves easily, so small amounts of power can push the speaker beyond its limit. Micro speaker systems normally add a high-pass filter at around 1000 Hz to reduce the excursion. This can minimize the impact of the resonance peak, but losing the bass significantly degrades the sound quality.

Acoustic performance of micro speakers used in smartphones and other devices such as laptops and notebooks usually drops below 1000 Hz for the reasons mentioned in Section [4]. For example, audio performance of a smartphone speaker drops by about 40-50 dB below 1000 Hz (e.g., between 100-1000 Hz). The low and mid-frequency performance of smartphone speakers is thus significantly deteriorated.

U.S. Pat. No. 9,161,119 to Powell is directed toward a speaker system with an enclosure having a spiral pathway. The speaker system includes an electro-acoustic transducer that generates sound according to an audio input. The speaker system also includes an enclosure having an interior pathway defined by a wall that is curved substantially as a spiral. The speaker system is configured such that the sound generated by the electro-acoustic transducer travels along at least a portion of the curved pathway, before leaving the enclosure (Abstract).

However, as seen FIG. 6 of the patent to Powell, the transducer is positioned so that the sound is projected into the tightest region of the spiral, and travels therefrom through the spiral to the broadest point thereof, from which the sound exits the speaker. However, this construction is disadvantageous and would be inefficient for micro speakers used in smartphones and other small devices in the low to mid-frequency range as a single spiral may provide insufficient expansion in a small space for acoustic impedance of the speaker source to be reduced to that of the ambient medium.

Thus, there is a need in the art for a speaker that accurately reproduces and amplify sound when wavelengths far exceed that of the available length to propagate a wave.

SUMMARY OF THE DISCLOSED TECHNOLOGY

In accordance with an embodiment of the disclosed technology, there is provided a method of passively amplifying acoustic output of a speaker over a broad frequency range, the method including aligning an opening into a first spiral channel towards a conventional loudspeaker and outputting sound through the conventional speaker substantially in a direction of the opening, wherein the sound output from the conventional speaker travels along the first spiral channel from a wide end to an apex thereof.

In some embodiments, amplified sound is output from an opening at the apex of the first spiral channel.

In some embodiments, the method further includes aligning an apex of a second spiral channel toward the apex of the first spiral channel, and connecting the apex of the first spiral channel to the apex of the second spiral channel using a communication tube, wherein the sound output from the conventional speaker travels from the apex of the first spiral channel, via the communication tube, to the apex of the second spiral channel, and travels along the second spiral channel to a wide end thereof.

In some embodiments, amplified sound is output from an opening at the wide end of the second spiral channel.

In some embodiments, the method further includes, prior to the aligning, configuring at least one of a frequency range and an amplification pattern of the first spiral channel. In some such embodiments, the configuring includes optimizing two angular dependent coefficients $a(\theta)$ and $b(\theta)$ well as angular span $\theta_1$ and $\theta_2$ of In some embodiments, the conventional speaker is an internal speaker of an electronic device.

In some embodiments, the first spiral channel is fixedly attached to a unitary housing, and the unitary housing covers substantially a side of the electronic device.

In some embodiments, the electronic device includes a cellular phone network transceiver, a display, the conventional speaker, and a microphone.

In accordance with another embodiment of the disclosed technology, there is further provided a passive frequency amplifier including a first spiral channel extending from a first sound intake opening at a wide end of the first spiral channel to a first sound exit at an apex of the first spiral channel, wherein the first spiral channel is adapted to receive sound output from a conventional speaker and to amplify the sound by the sound travelling from the first sound intake opening to the first sound exit.

In some embodiments, the passive frequency amplifier further includes a second spiral channel extending from a second sound intake opening at an apex of the second spiral channel to a second sound exit at a wide end of the second spiral channel and a communicating tube acoustically connecting the apex of the first spiral channel to the apex of the second spiral channel, wherein the second spiral channel is adapted to receive sound from the first sound exit of the first spiral channel, via the communicating tube, and to amplify the sound by the sound travelling from the second sound intake opening to the second sound exit.

In some embodiments, at least one of a frequency range and an amplification pattern of the first spiral channel are configured by optimizing two angular dependent coefficients $a(\theta)$ and $b(\theta)$ well as angular span $\theta_1$ and $\theta_2$ of $r(\theta)=a(\theta)e^{b(\theta)*\theta}$.

In some embodiments, an amplification system according to the disclosed technology includes a passive frequency amplifier including a single spiral as disclosed hereinabove, and a conventional speaker outputting sound substantially toward the first sound intake opening at the wide end of the first spiral channel, wherein the sound output from the conventional speaker travels along the first spiral channel from the first sound intake opening at the wide end to the apex of the first spiral channel, and is output to a surrounding environment from the first sound exit at the apex of the first spiral channel.

In some embodiments, the conventional speaker is an internal speaker of an electronic device.

In some embodiments, the first spiral channel is fixedly attached to a unitary housing, and the unitary housing covers substantially a side of the electronic device.

In some embodiments, the electronic device includes a cellular phone network transceiver, a display, the conventional speaker, and a microphone.

In some embodiments, an amplification system according to the disclosed technology includes a passive frequency amplifier having first and second spirals as disclosed hereinabove, and a conventional speaker outputting sound substantially toward the first sound intake opening at the wide end of the first spiral channel, wherein the sound output from the conventional speaker travels along the first spiral channel from the first sound intake opening at the wide end of the first spiral channel to the apex of the first spiral channel, passes via the communicating tube to the second sound intake opening of the second spiral channel and travels along the second spiral channel to the wide end thereof, and is output to a surrounding environment from the second sound exit at the wide end of the second spiral channel.

In some embodiments, the conventional speaker is an internal speaker of an electronic device.

In some embodiments, the first spiral channel is fixedly attached to a unitary housing, and the unitary housing covers substantially a side of the electronic device.

In some embodiments, the electronic device includes a cellular phone network transceiver, a display, the conventional speaker, and a microphone.

"Substantially" and "substantially shown," for purposes of this specification, are defined as "at least 90%," or as otherwise indicated. Any device may "comprise" or "consist of" the devices mentioned there-in, as limited by the claims.

It should be understood that the use of "and/or" is defined inclusively such that the term "a and/or b" should be read to include the sets: "a and b," "a orb" "a" "b."

DETAILED DESCRIPTION OF EMBODIMENTS OF THE DISCLOSED TECHNOLOGY

Figure 1A:
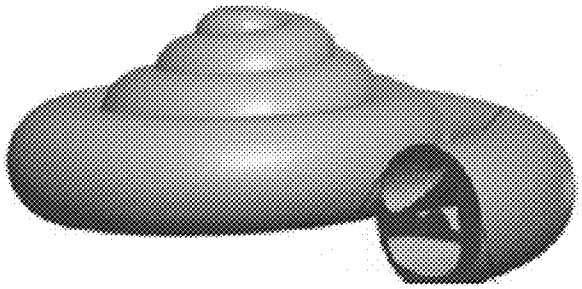
FIGS. 1A and 1B show a photo of a cochlea and a spiral associated therewith.

Acoustic meta materials (AMM) allow broadband sound to be manipulated on a sub-wavelength scale, that is, on a scale much smaller than the wavelength in air, and from the far field using sub-wavelength acoustic resonators. Because evanescent waves are bound to a source, propagating them to far-field requires conversion of the evanescent waves into propagating waves by lessening their momentum. Such a conversion can be accomplished using anisotropic media. However, for such a conversion to occur and to achieve the required medium, a high refractive index material is desired. For acoustic waves propagating in air, it is difficult to find a natural material with a refractive index higher than air. It may be noted that water has a lower refractive index than air.

Sound radiation from a loudspeaker at low frequencies is extremely low, due to the smallness of the source size (D) relative to large wavelength ($\lambda$) of low frequency sound ($D \ll \lambda$). As a result of the reactive impedance being very high on the loudspeaker diaphragm, there is little energy in the propagating waves, which carry sound to far-field. The evanescent waves dominate at low frequencies. Such evanescent waves stick to their source, their amplitude decreasing exponentially with distance, and are negligible at about a wavelength away from the source.

Loudspeakers, also known as speakers, convert an electrical impulse into a mechanical impulse which produces sound, usually by use of electromagnetism which moves a cone. For purposes of this disclosure, a "loudspeaker" is defined as an electro-acoustic transducer, which converts an electrical signal into audio output.

As mentioned hereinabove, conventional loudspeaker systems have poor bass reproduction if the housings are small. Air compression forces in small housings tend to build up and impede the movement of the radiating loudspeaker's membrane causing the amplitude or quality (harmonics) of the reproduced sound to be noticeably different from, and/or noticeably inferior to, the original sound, even according to an ordinary observer.

The loudspeakers are almost always the limiting element on the fidelity of a reproduced sound in a home or theater environment. Ideally, the loudspeaker systems must themselves be musical instruments of the highest order. The main problem in meeting this objective has been the conversion of the mechanical vibrations of the loudspeaker into sound waves, which closely represent the electrical signal. This is a problem particularly at low frequencies, when the speaker cone is moving back and forth slowly, it is incapable of developing sufficient pressure to create sound waves. This applies to all sounds below a certain critical frequency, depending on the diameter of the cone used. The efficiency of a loudspeaker in creating sound usually is about 0.5%, i.e. 5E-3.

Impedance in both acoustic and electrical systems consists of two parts. One is purely 'resistive', analogous to an electrical resistor having a resistance in ohms. The other part is purely 'reactive' and represents the opposition to air flow caused by having to move air masses around or by compressing the air itself. Energy is dissipated or lost in the resistive part whereas it is not lost in the reactive part.

Sound radiation from a loudspeaker at low frequencies is extremely low, due to the smallness of the source size (D) relative to large wavelength ($\lambda$) of low frequency sound ($D \ll \lambda$). At low frequencies, such as 100 Hz, wavelength of sound in air is about 3.42 m. The sound power radiated to far field by a monopole is proportional to $(kD)^2$, where $k=2\pi/\lambda$, and the power decreases proportionally for higher multipoles. For frequencies of interest, which are less than 100 Hz, $k<1.898\ m^{-1}$. The acoustic impedance of a loudspeaker cone may be given by:

$$Z=\rho_0 cS[R_1(2ka)+jX_1(2ka)]$$

The resistive part is termed $R_1$, and the imaginary part is also called the reactance part. For an average woofer diameter (8 inch) this gives a ka product of less than 0.2. For this value the above equation may be represented as:

$$Z_r \approx \rho_0 cS\left(\frac{(ka)^2}{2} + j\frac{8ka}{3\pi}\right)$$

Since ka is small, the resistive term is negligible and we are left with a purely reactive impedance. Rearranging the variables in the equation results in the following:

$$Z_r \approx j\omega\rho_0 S\left(\frac{8a}{3\pi}\right)$$

Since the impedance of a mass is given by:

$$Z_m=j\omega m$$

The radiation impedance at low frequencies is equivalent to adding a mass to the cone of:

$$m_r = \rho_0 S\left(\frac{8a}{3\pi}\right)$$

Note that this approximation is only valid at low frequencies, in the region where we wish to "tune" the enclosure. This approximation is not valid for calculating the frequency response of a loudspeaker over a wide frequency range.

The loudspeaker, which is a generator of acoustic pressure, has an internal (source) acoustic impedance and drives an external load (air) impedance. The air is the ultimate load, and the impedance of air is low, because of its low density. The source impedance of any loud speaker, on the other hand, is high, so there will be a considerable mismatch between the source and the load. Thus, most of the energy being put into a direct radiating loudspeaker will not reach the air, but will be converted to heat in the voice coil and mechanical resistances in the unit. The problem becomes worse at low frequencies, where the size of the source is small compared to a wavelength and the source will merely push the medium away. At higher frequencies, the radiation from the source will be in the form of plane waves that do not spread out. At the higher frequencies, the load, as seen from the driver, is at its highest, and the system is as efficient as it can be.

The bass response of a loudspeaker can be improved by using back radiation. However, the front and back radiation is in anti-phase—and an "acoustic phase inverter" is required for adding the front and back radiation constructively. Loudspeaker enclosures implement the "phase inversion", by coupling front and back radiation from the low frequency unit(s) through an acoustic phase inverting network.

In the design of musical instruments and speaker enclosures, generally speaking, the only common acoustic transducers previously in use are the pipe, the Helmholtz resonator and the horn. The horn, reminiscent of the exponential, has been used in various forms to load the back wave of a speaker, thus providing additional coupling to ambient air at low frequencies. Such horns, however, need to be very large and long to be effective.

A Helmholtz resonator is simply a box with a port on its front side to couple the enclosed volume of the airspace in the box to the ambient air in the room. The depth of the enclosed airspace in the box behind the port, and the width and depth of the port, control the resonant frequency of the bass trap. The ported box is basically a Helmholtz resonator (enclosed volume of air with aperture) similar to wind instruments. The resonator generates an artificial bass to represent the lowest notes. These generated notes have a separate tonal quality to the notes above them and are in reverse phase. A woofer diaphragm mounted in a speaker cabinet may boost low frequency radiation, which is not omnidirectional, and additionally there are requirements of damping sound in the cabinet.

An acoustic horn may be viewed as an acoustic impedance transformer. When a loudspeaker diaphragm vibrates, it creates pressure waves. This is the sound we hear. Coupling the motion of the diaphragm to the air is not an easy thing to do, as the densities of the vibrating diaphragm and the air differ. This is usually called an impedance mismatch. It is known that sound travels better in high-density than in low-density materials, and in a speaker system, the diaphragm is the high-density (high-impedance) medium, and air is the low-density (low-impedance) medium. The horn assists the solid-air impedance transformation by acting as an intermediate transition medium. In other words, it creates higher acoustic impedance for the transducer to work into, thus allowing more power to be transferred to the air. A typical horn is a tube whose cross-section increases exponentially. The narrow end is called the "throat," and the wide end is called the "mouth." The transducer is placed at the throat. When the diaphragm moves near the throat, high pressure occurs with low amplitude in a small area. As the pressure wave moves towards the mouth, pressure decreases and amplitude and velocity increases, thus realizing excellent natural and efficient amplification. Horns may have very special properties, including lower distortion and faster transient response than conventional drivers, and they are easier to drive at high SPL's than conventional drivers. However, while a loudspeaker mouth connected to a horn improves sound radiation, it confines radiation in limited space.

As mentioned above, impedance in both acoustic and electrical systems consists of a 'resistive' portion and a 'reactive' portion, such that energy is dissipated or lost in the resistive portion, but not in the reactive portion. For organ pipes, the resistive element of impedance determines the amount of sound energy which propagates into the atmosphere beyond the pipe and which we hear as its sound. This variety of resistance is called the 'radiation resistance' against which the pipe has to work. The reactive element represents air movement close to the pipe. This motion does not propagate or dissipate any energy from the pipe; rather the 'reactive' air just moves around locally. During each cycle of oscillation, the 'reactive' air temporarily stores energy from the pipe and then gives it back again. At low frequencies, such as 100 Hz, wavelength of sound in air is 3.42 m ($\lambda$=c/f, where c is speed of sound and f is frequency), the length of organ pipe needs to be at least equal to quarter of wavelength, i.e., 3.42/4 ($\lambda$/4=0.855 m). This results in a long organ pipe of 0.855 m (or 2.8 ft or 33.66 inch) for 100 Hz.

Refraction is a phenomenon that often occurs when waves travel from a medium with a given refractive index to a medium with another refractive index, at an oblique angle. At the boundary between the media, the wave's phase velocity is altered, usually causing a change in direction. Its wavelength increases or decreases, but its frequency remains constant. Refractive index is defined as the factor by which the wavelength and the velocity of the propagating wave are reduced in the medium as it passes through with respect to their vacuum values. Refraction occurs because of a change of speed of propagation of the wave. When light passes from air to water it slows down, whereas when sound travels from air to water it speeds up. Therefore, in the passage from air to water, sound is refracted away from the normal, whereas light is refracted towards the normal. The speed of sound is greater in water than in air, so the wavelength in water is greater than in air. In effect, the refractive index of the water is less than the refractive index of the air.

Snell's Law describes the relationship between the angles and the velocities of the waves. Snell's law equates the ratio of material velocities $V_1$ and $V_2$ to the ratio of the sine's of incident ($Q_1$) and refracted ($Q_2$) angles, as shown in the following equation.

$$\frac{\sin\theta_1}{\sin\theta_2} = \frac{V_{L1}}{V_{L2}} = \frac{n_2}{n_1}$$

Where $V_{L1}$ is the longitudinal wave velocity in material 1, $V_{L2}$ is the longitudinal wave velocity in material 2, and $n_1^{n_1}$ and $n_2$ are refractive indices of the two mediums.

For miniature acoustic devices, higher refractive index acoustic mediums are desired to slow down the speed of sound waves. For acoustic waves propagating in air, however, it is difficult to find a natural material with acoustic refractive index higher than that of air. In acoustics, slow sound is a relatively new concept and a remarkable matter with potential applications to audio systems. Acoustic meta materials offer a way to design acoustic materials with high refractive index and corresponding slow sound speed. Broadband audible range sound can be manipulated and focused on a sub-wavelength scale, that is, on a scale much smaller than the wavelength in air, and from the far field using sub-wavelength acoustic resonators, as described in further detail herein below.

Acoustic meta materials (AMMs) are defined as engineered structures that exhibit unusual effective material properties such as density, bulk modulus, and refractive index, with negative, zero or highly anisotropic values (having a physical property that has a different value when measured in different directions). Acoustic meta materials are artificially fabricated materials designed to control, direct and manipulate sound waves. In meta materials with high refractive index, acoustic waves are forced to travel in a narrow channel system thereby increasing the total propagation time and leading to a low sound velocity and a high refractive index. The propagating phase along these winding sub-channels can be arbitrarily delayed in order to mimic a high refraction index.

Using AMM, wave-controlling structures can be designed on scales much smaller than the wavelength of interest, typically 5% to 20% of such wavelengths. Space-coiling meta materials employ deep sub-wavelength meandering wave-guiding channels to effectively slow down acoustic waves. Spiral geometries are preferred, both by nature and by engineers, since they are inherently tapered structures with simple mathematical expressions. Natural and engineered examples involving spirals can be found in many gastropod shells (e.g., conch shells etc.), cochlea of human inner ears, as well as architectural designs and microwave antennas.

When a high impedance source, such as a loudspeaker, radiates sound into a very low impedance load, such as open air, it sets up an inefficient sound radiation mechanism. Additionally, there is hardly any control over the sound radiation process, once a loudspeaker radiates sound into open air, because the process is dictated by the physics of sound radiation. As mentioned above, AMM technology can control and direct sound with deep sub-wavelength devices. If sound radiated by loudspeaker is guided in some way and is radiated in an optimized pattern, its radiation efficiency can be significantly improved.

Figure 1B:
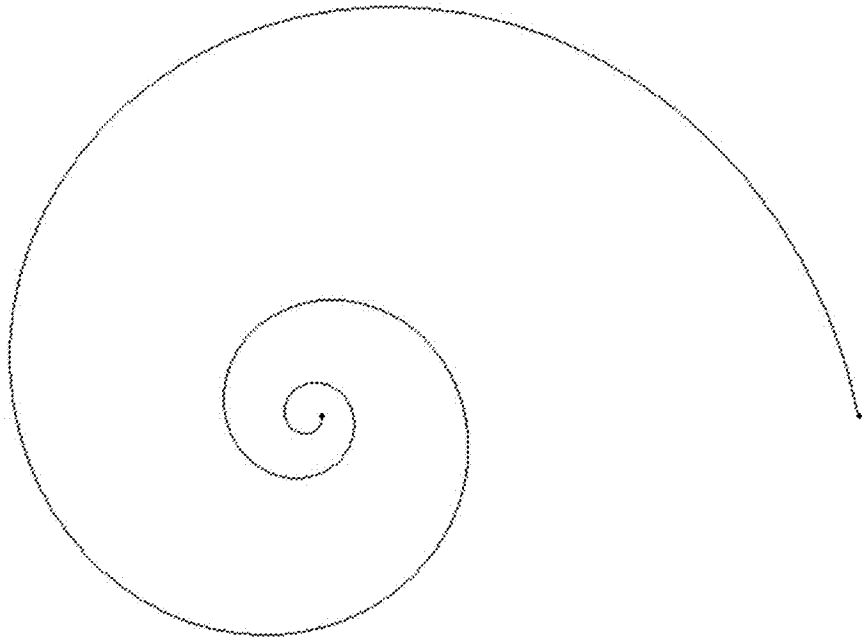

An AMM passive amplifier device based on spiral geometry is presented in this invention disclosure. Spiral geometry are prevalent in nature, such as in human and mammalian cochlea. Early theory about the snail shell shape of the mammalian cochlea is that it evolved essentially and perhaps solely to conserve space inside the skull. Recently, it has been shown that coiling allowed the cochlea to become longer, increasing the potential octave range, whereas uncoiled cochleae have been associated with relatively limited hearing ranges. FIGS. 1A and 1B, respectively, show a photo of a cochlea and an exponential spiral representing the path inside the cochlea. Because of the increased potential octave range, a structure similar to that of a cochlea, which follows an exponential or Fibonacci spiral, is suitable for amplification of sound in accordance with the disclosed technology.

Figures 2A, 2B:
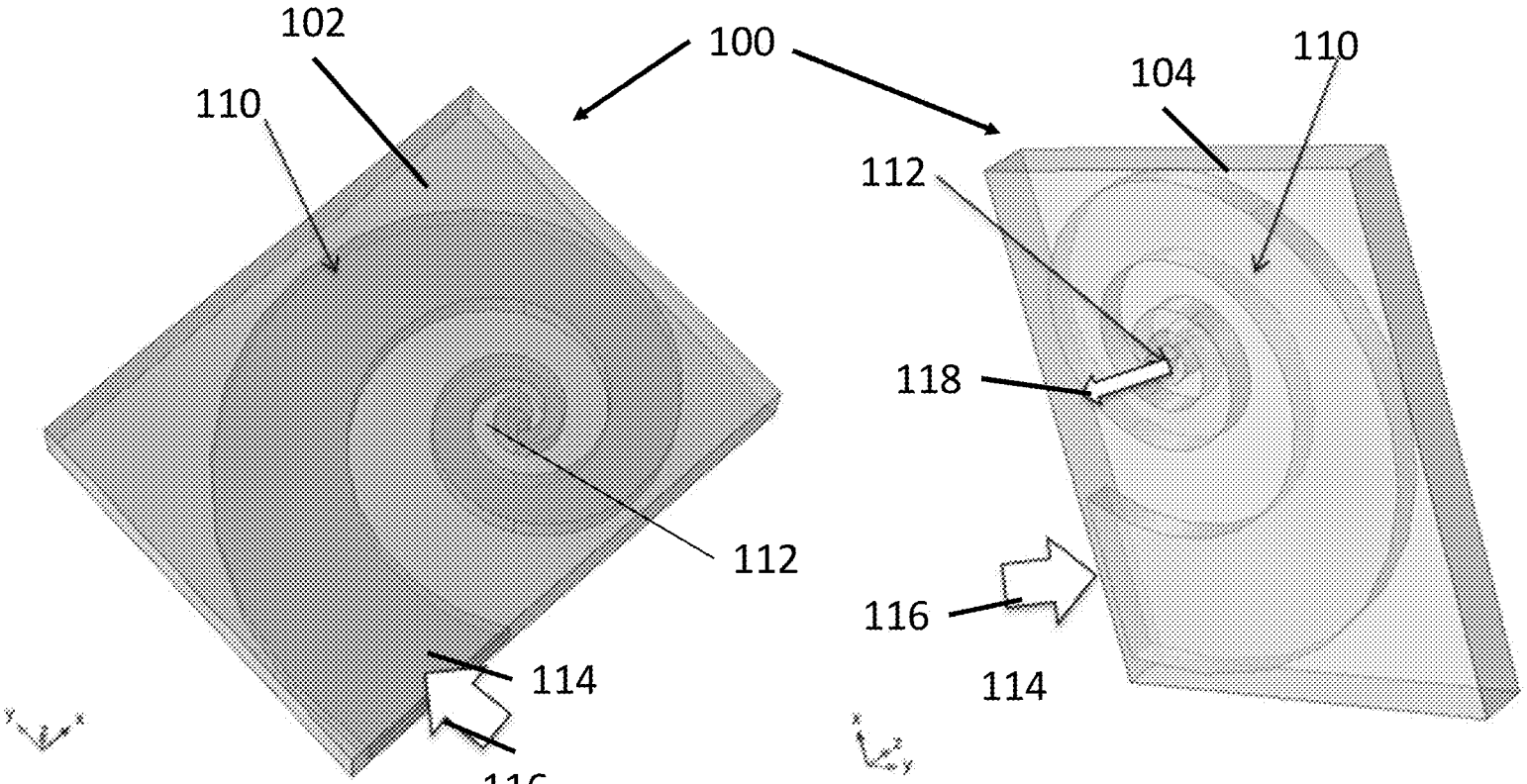
FIGS. 2A and 2B, respectively, show front and back sides of an AMM spiral amplifier according to an embodiment of the disclosed technology.

As mentioned above, spiral geometries are favored both by nature and engineers, and are inherently tapered structures with simple mathematical expressions. FIGS. 2A and 2B show front and back sides of a spiral channel used in embodiments of the disclosed technology. The spiral curve of the spiral channel can be expressed in parametric form as $r(\theta)=a(\theta)e^{b(\theta)*\theta}$. By tuning the two angular dependent coefficients $a(\theta)$ and $b(\theta)$ well as angular span $\theta_1$ and $\theta_2$, a large range of effective parameters can be covered. In order to estimate the level of space coiling of the unit cells, a geometric factor $\eta \overset{\circ}{\times} L_{av}/D$, termed as coiling coefficient, can be defined, in which $L_{av}$ is the average wave path inside the meandering spiral channel and D is the side length of the spiral cell along the wave propagation direction. The complex impedance $Z_{eff} \overset{\circ}{\times} R_{eff} \overset{i}{\times} jX_{eff}$ of the anisotropic spiral cell is dominated by its imaginary part $X_{eff}$ below its cut off frequency, thus the transmission through the spiral is relatively low. This dispersion property is similar to an exponential horn waveguide characterized by $r(\beta)=\alpha e^{(h\beta)}$, which is a high-pass structure with a cutoff frequency depending on its geometrical factor h. The high-pass property of the anisotropic spiral is expected since its impedance can be regarded as a series connection of two identical quasi-exponential waveguides.

A spiral shape effectively boosts the strength of the sound waves, especially for low frequencies. As the wave travels along the spiral, this energy increasingly accumulates near the outside edge of the spiral, rather than remaining evenly spread across it. Low frequencies travel the furthest into the spiral, so the effect is strongest for them. This sound propagation is similar to the "whispering gallery modes" first described for London's St. Paul's Cathedral, where even quiet sounds can travel long distances, skipping along a cylindrical wall without losing energy. For sound traveling along the spiral; the increasingly tighter turns ensure that the rays of sound will "focus" steadily closer to the wall and near the apex. It has been found that the cochlea may be more sensitive further up the tube, where lower frequencies are detected. It has been estimated that sound at the apex of the cochlea spiral is boosted by about 20 decibels relative to sound at the outer face: the difference between the volume of a normal conversation and that of a vacuum cleaner.

As seen in FIGS. 2A and 2B, an AMM spiral amplifier 100 according to the disclosed technology has a front side 102 and a back side 104. The amplifier 100 includes channels 110 formed in the shape of a spiral, extending from a spiral apex 112 to a relatively wide spiral opening 114. In accordance with the disclosed technology, sound is received from a sound source, such as a diaphragm of a speaker, at the wide spiral opening 114, as indicated by arrows 116. The sound is guided along channel 110 inward toward spiral apex 112, thereby focusing the sound, which is then output from spiral apex 112, as indicated by arrow 118. As explained in further detail hereinbelow, in some embodiments, an interconnecting tube extends from spiral apex 112 toward the back side 104, such that the output sound is guided through the interconnecting tube to another sound guiding structure.

The frequency range and amplification pattern of an AMM spiral device such as device 100 can be tailored by optimizing the two angular dependent coefficients $a(\theta)$ and $b(\theta)$ well as angular span $\theta_1$ and $\theta_2$ of the equation $r(\theta)=a(\theta)e^{b(\theta)*\theta}$. Such an AMM spiral amplifier my cover a broadband frequency range.

The spiral channel 110 of amplifier 100 is an anisotropic system with a high refractive index medium (where sound passes through the pathway cut into the device x at a ratio of at least 100:1 compared to passage through the solid medium). The spiral pattern of the channel 110 can be easily miniaturized to be incorporated in small electronic devices, or enlarged to be suitable for larger devices.

At the narrowest portion thereof, i.e. at the apex, the width of the spiral channel may be in the range of 0.2 mm to 2 mm. The number of spiral coils also affects the frequency range, particularly over the lower end. A minimum of two and half turns in the spiral coil is required to amplify sound in the bass frequency range. The flare of the output section of the spiral, particularly in the twin spiral design described herein below, also has significant effect on lower end of the frequency range. Thus, the spiral equation discussed hereinabove is used to determine various parameters of spiral amplifier design. Additionally, numerical calculations using the spiral equations are used to ascertain the performance of the AMM spiral amplifier.

The refractive index of channel 110 depends on dimensions of the channel and total distance sound waves will travel. Acoustic pressure waves can propagate freely in the air channel without a cut-off frequency due to the longitudinal property of acoustic waves. It may be mentioned that sound waves in air (and any fluid medium) are longitudinal waves because particles of the medium through which the sound is transported vibrate parallel to the direction that the sound wave moves. Sound moving through air compresses and rarefies the gas in the direction of travel of the sound wave as it vibrates back and forth. In other words, low frequency acoustic waves approximately travel along the spiral path. The effective refractive index is relatively high, since the propagation time from the inlet to top outlet is delayed/increased by coiling up the channel in space.

Figure 3A:
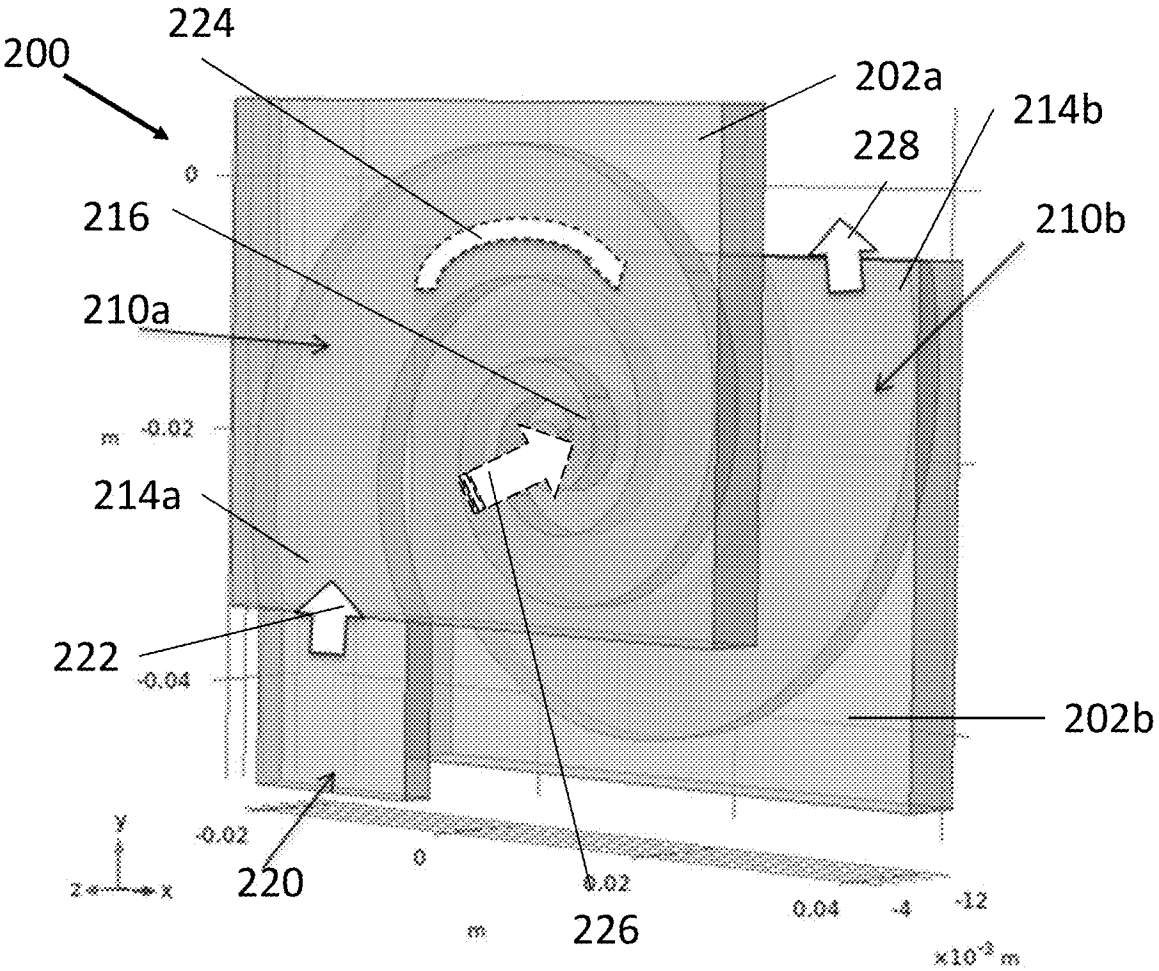
FIGS. 3A and 3B, respectively show a schematic perspective view and a schematic side view of an AMM twin amplifier device according to an embodiment of the disclosed technology.
Figure 3B:
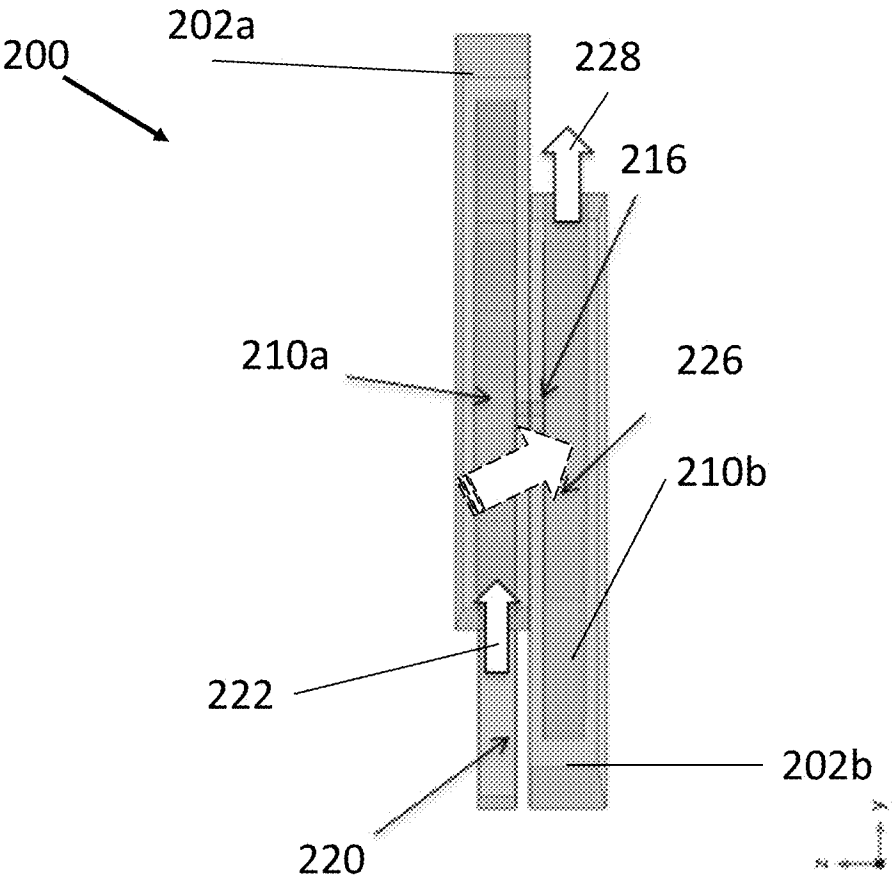

Reference is additionally made to FIGS. 3A and 3B, which show a schematic perspective view and a schematic side view of an AMM passive twin amplifier device 200 according to an embodiment of the disclosed technology. As seen, the AMM passive twin amplifier device 200 is based on a pair of exponential spiral amplifiers, at least one of which may be similar to amplifiers of FIGS. 2A and 2B.

As seen in FIGS. 3A and 3B, two exponential spiral amplifiers 202*a* and 202*b* are arranged such that their channels 210*a* and 210*b* extend in opposing spiral directions, but their apices are aligned. As such, wide spiral openings 214*a* and 214*b* are disposed on opposing sides of the twin amplifier device 200. An interconnecting tube 216 interconnects the apices of channels 210*a* and 210*b*, such that air, and waves therein, can travel from one channel to the other.

In use, sound from a loudspeaker 220, such as a micro speaker typically used in hand-held and/or mobile electronic devices, enters first wide spiral opening 214*a* of first spiral amplifier 202*a*, as indicated by arrow 222. The sound travels in a spiraling in direction along first channel 210*a*, as indicated by arrow 224, to be focused into the apex of the first spiral amplifier 202*a*. The sound then travels through interconnecting tube 216 to the apex of second channel 210*b*, as indicated by arrow 226, and travels along the channel 210*b* in a spiraling-out direction until it is output via second wide spiral opening 214*b*, as indicated by arrow 228.

As the sound originating from speaker 220, which is a high impedance source with high acoustic pressure and low velocity, travels in a spiraling-in direction along the first spiral channel 210*a*, its velocity picks up and its acoustic pressure is lowered, thereby lowering its impedance at the first apex of the first spiral. However, the impedance at the first apex is still higher than impedance of air, and needs to be reduced further. This requires the second spiral channel 210*b* to expand sound from the apex of the first spiral channel. Sound from the apex of the first spiral channel 210*a* is passed to that of the second spiral channel 210*b* by an inter-connecting tube 216. Sound now expands from the apex of the second spiral channel 210*b* to the large opening 214*b*, thereby further lowering acoustic pressure and increasing velocity. Thus, acoustic impedance is reduced again. As such, AMM passive twin spiral amplifier 200 presents an acoustic source at the end of second wide opening 214*b* of the second spiral channel 210*b* with much reduced impedance for efficient sound radiation into air.

Figure 4:
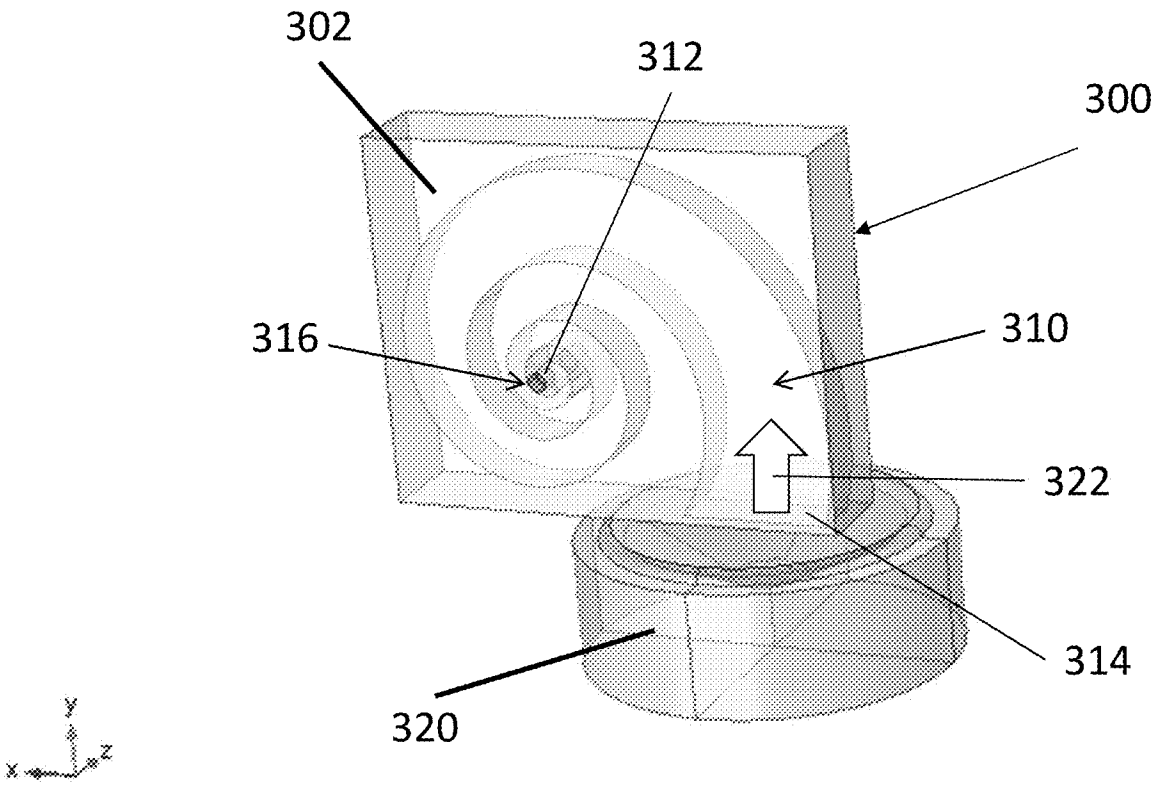
FIG. 4 is a schematic perspective illustration of an AMM single spiral amplifier device according to an embodiment of the disclosed technology.

Reference is now made to FIG. 4, which is a schematic perspective illustration of an AMM single spiral amplifier device 300 according to an embodiment of the disclosed technology. As seen in FIG. 4, an exponential spiral amplifier 302 is similar to the amplifier described hereinabove with respect to FIGS. 2A and 2B, and has a channel 310 defining a central apex 312 and a wide spiral opening 314. An output tube 316 may be disposed at apex 312 to provide output therefrom. In use, sound from a loudspeaker 320, such as a miniature speaker typically used in hand-held and/or mobile electronic devices, enters first wide spiral opening 314, as indicated by arrow 322. The sound travels in a spiraling in direction along channel 310, to be focused into the apex 312. The sound is then output to the surrounding environment from apex 312, for example via output tube 316.

As the sound originating from speaker 320, which is a high impedance source with high acoustic pressure and low velocity, travels in a spiraling-in direction along the first spiral channel 310, its velocity picks up and its acoustic pressure is lowered, thereby lowering its impedance at the first apex of the first spiral.

Figure 5A:
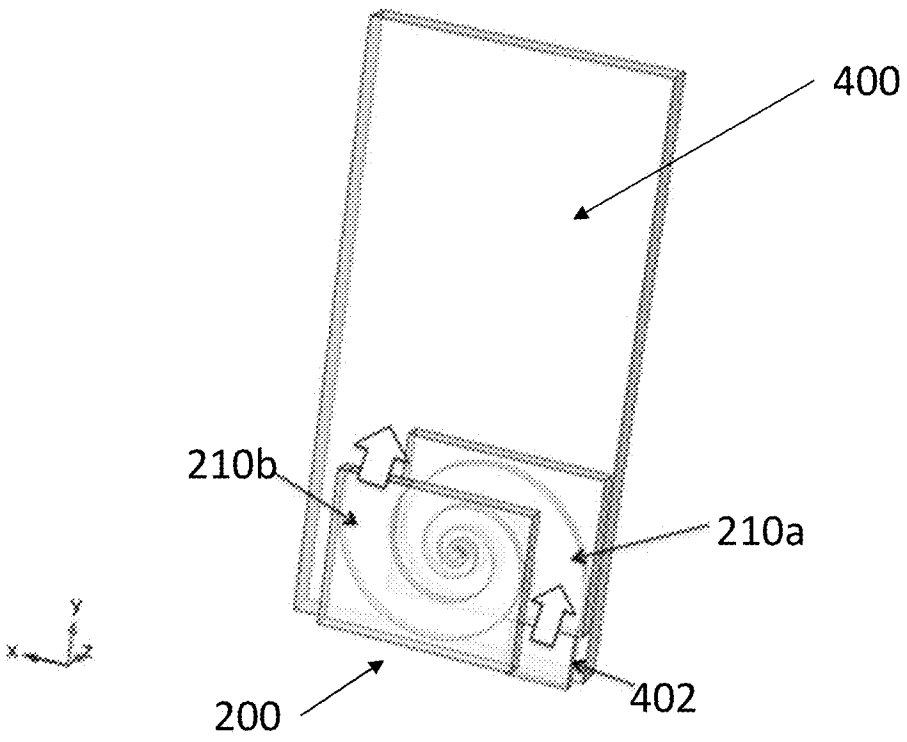
FIGS. 5A and 5B show two arrangements of AMM twin spiral amplifier attached to the back of a hand-held electronic device.
Figure 5B:
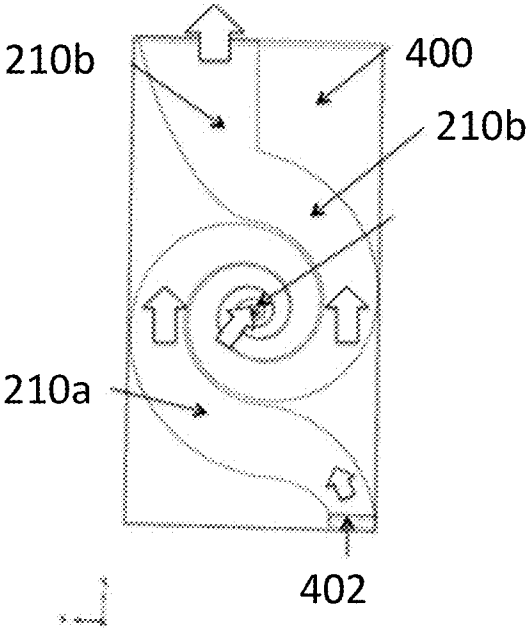

Reference is now made to FIGS. 5A and 5B, which show two embodiments of AMM twin spiral amplifiers 200, similar to that of FIGS. 3A and 3B, attached to the back of a hand-held electronic device 400. The channels 210*a* and 210*b* of the twin spiral amplifiers 200 can be located inside or outside of the device, such as in a case (not explicitly shown). The hand-held electronic device 400 in the illustrated embodiment is a mobile phone, which has cellular network connectivity, a display screen, a speaker, and a microphone. The AMM twin spiral amplifier 200 is arranged in a path of sound emanating from the speaker 402 of mobile phone 400, such that sound is funneled into a channel of AMM twin spiral amplifier 200, as described hereinabove with respect to FIGS. 3A and 3B, in an embodiment of the disclosed technology. The entire AMM twin spiral amplifier shown can be less than 5 centimeters from speaker and can be fitted inside or outside of the mobile phone. The AMM twin spiral amplifier may resemble a thin sheet, for example having a thickness in the range of 2 mm to 3 mm, which allows it to be fitted to any audio speaker or electronic device.

The design of twin spirals can be tailored according to desired bandwidth, amplification and space available, For example, FIG. 5B shows an alternate design of twin spiral design which fits on the back of a smartphone and covers broadband frequency range.

Figure 6:
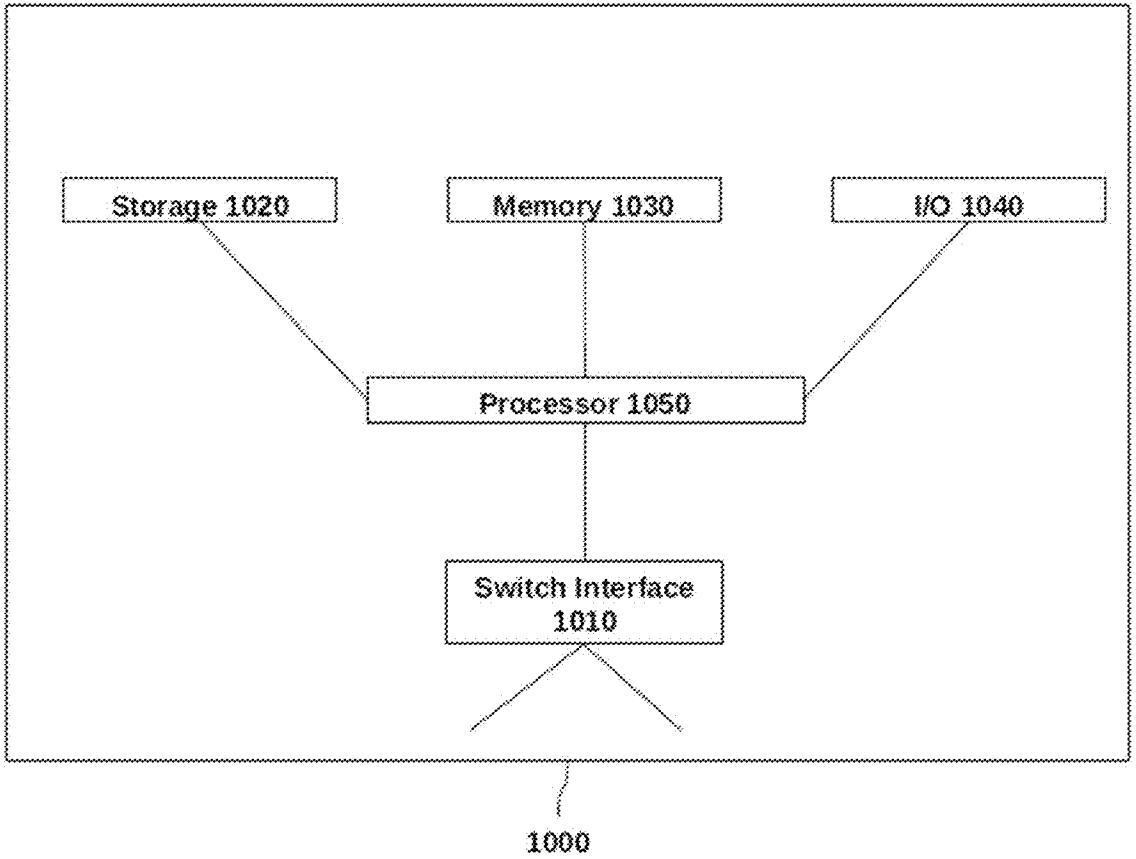
FIG. 6 is a high level block diagram showing devices on which embodiments of the disclosed technology may be carried out.

FIG. 6 shows a high-level block diagram of a device that may be used to carry out the disclosed technology. Device 1000 comprises a processor 1050 that controls the overall operation of the computer by executing the device's program instructions which define such operation. The device's program instructions may be stored in a storage device 1020 (e.g., magnetic disk, database) and loaded into memory 1030, when execution of the console's program instructions is desired. Thus, the device's operation will be defined by the device's program instructions stored in memory 1030 and/or storage 1020, and the console will be controlled by processor 1050 executing the console's program instructions. A device 1000 also includes one, or a plurality of, input network interfaces for communicating with other devices via a network (e.g., the Internet). The device 1000 further includes an electrical input interface. A device 1000 also includes one or more output network interfaces 1010 for communicating with other devices. Device 1000 also includes input/output 1040, representing devices which allow for user interaction with a computer (e.g., display, keyboard, mouse, speakers, buttons, etc.). One skilled in the art will recognize that an implementation of an actual device will contain other components as well, and that FIG. 6 is a high level representation of some of the components of such a device, for illustrative purposes. It should also be understood by one skilled in the art that the method and devices depicted in FIGS. 1 through 5B may be implemented on a device such as is shown in FIG. 6.

Further, it should be understood that all subject matter disclosed herein is directed, and should be read, only on statutory, non-abstract subject matter. All terminology should be read to include only the portions of the definitions which may be claimed. By way of example, "computer readable storage medium" is understood to be defined as only non-transitory storage media.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A method of passively amplifying acoustic output of a speaker over a broad frequency range, comprising:

aligning an opening into a first spiral channel towards a loudspeaker;

aligning an apex of a second spiral channel toward said apex of said first spiral channel;

connecting said apex of said first spiral channel to said apex of said second spiral channel using a communication tube; and outputting sound through said loudspeaker substantially in a direction of the opening, wherein said sound output from said loudspeaker travels along said first spiral channel from a wide end to an apex thereof, and wherein said sound output from said loudspeaker travels from said apex of said first spiral channel, via said communication tube, to said apex of said second spiral channel, and travels along said second spiral channel to a wide end thereof.

2. The method of claim 1, wherein amplified sound is output from an opening at said apex of said first spiral channel.

3. The method of claim 1, wherein amplified sound is output from an opening at said wide end of said second spiral channel.

4. The method of claim 1, further comprising, prior to said aligning said opening into said first spiral channel, configuring at least one of a frequency range and an amplification pattern of said first spiral channel.

5. The method of claim 1, wherein said loudspeaker is an internal speaker of an electronic device.

6. The method of claim 5, wherein said first spiral channel is fixedly attached to a unitary housing, and said unitary housing covers substantially a side of said electronic device.

7. The method of claim 5, wherein said electronic device comprises a cellular phone network transceiver, a display, said loudspeaker, and a microphone.

8. A passive frequency amplifier comprising:

a first spiral channel extending from a first sound intake opening at a wide end of said first spiral channel to a first sound exit at an apex of said first spiral channel;

a second spiral channel extending from a second sound intake opening at an apex of said second spiral channel to a second sound exit at a wide end of said second spiral channel; and a communicating tube acoustically connecting said apex of said first spiral channel to said apex of said second spiral channel, wherein said first spiral channel is adapted to receive sound output from a speaker and to amplify said sound by said sound travelling from said first sound intake opening to said first sound exit, and wherein said second spiral channel is adapted to receive sound from said first sound exit of said first spiral channel, via said communicating tube, and to amplify said sound by said sound travelling from said second sound intake opening to said second sound exit.

9. An amplification system, comprising:

a passive frequency amplifier according to claim 8; and said speaker outputting sound substantially toward said first sound intake opening at said wide end of said first spiral channel, wherein said sound output from said speaker travels along said first spiral channel from said first sound intake opening at said wide end of said first spiral channel to said apex of said first spiral channel, passes via said communicating tube to said second sound intake opening of said second spiral channel and travels along said second spiral channel to said wide end thereof, and is output to a surrounding environment from said second sound exit at said wide end of said second spiral channel.

10. The amplification system of claim 9, wherein said speaker is an internal speaker of an electronic device.

11. The amplification system of claim 10, wherein said first spiral channel is fixedly attached to a unitary housing, and said unitary housing covers substantially a side of said electronic device.

12. The amplification system of claim 10, wherein said electronic device comprises a cellular phone network transceiver, a display, said speaker, and a microphone.

* * * * *